US008315873B2

(12) United States Patent
Mori

(10) Patent No.: US 8,315,873 B2
(45) Date of Patent: Nov. 20, 2012

(54) SENTENCE READING ALOUD APPARATUS, CONTROL METHOD FOR CONTROLLING THE SAME, AND CONTROL PROGRAM FOR CONTROLLING THE SAME

(75) Inventor: Shinichiro Mori, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 470 days.

(21) Appl. No.: 12/463,532

(22) Filed: May 11, 2009

(65) Prior Publication Data

US 2009/0222269 A1 Sep. 3, 2009

Related U.S. Application Data

(63) Continuation of application No. PCT/JP2006/323427, filed on Nov. 24, 2006.

(51) Int. Cl.
*G10L 13/00* (2006.01)

(52) U.S. Cl. ..... 704/261; 704/258; 704/260

(58) Field of Classification Search ..... 704/267, 704/258, 260, 266, 270, 270.1, 259, 261; 715/758

See application file for complete search history.

(56) References Cited

U.S. PATENT DOCUMENTS

| | | | | |
|---|---|---|---|---|
| 6,708,152 | B2 * | 3/2004 | Kivimaki | 704/260 |
| 7,451,087 | B2 * | 11/2008 | Case et al. | 704/267 |
| 7,913,176 | B1 * | 3/2011 | Blattner et al. | 715/758 |

FOREIGN PATENT DOCUMENTS

| | | |
|---|---|---|
| JP | 6-35913 | 2/1994 |
| JP | 07-140996 | 6/1995 |
| JP | 8-87698 | 4/1996 |
| JP | 10-171485 | 6/1998 |
| JP | 10-228471 | 8/1998 |
| JP | 10-340095 | 12/1998 |
| JP | 2003-308085 | 10/2003 |
| JP | 2004-171174 | 6/2004 |
| JP | 2005-018037 | 1/2005 |
| JP | 2005-265477 | 9/2005 |
| JP | 2006-313176 | 11/2006 |

OTHER PUBLICATIONS

International Search Report mailed Feb. 27, 2007 for International Application No. PCT/JP2006/323427.

Japanese Office Action issued Nov. 22, 2011 in corresponding Japanese Patent Application No. 2008-545287 (2 pages).

* cited by examiner

*Primary Examiner* — Huyen X. Vo

(74) *Attorney, Agent, or Firm* — Staas & Halsey LLP

(57) ABSTRACT

An apparatus for voice synthesis includes: a word database for storing words and voices; a syllable database for storing syllables and voices; a processor for executing a process including: extracting a word from a document, generating a voice signal based on the extracted voice when the extracted word is included in the word database synthesizing a voice signal based on the extracted voice associated with the one or more syllables corresponding to the extracted word when the extracted word is not found in the word database; a speaker for producing a voice based on either of the generated and the synthesized voice signal; and a display for selectively displaying the extracted word when the voice based on the synthesized voice signal is produced by the speaker.

6 Claims, 7 Drawing Sheets

FIG. 2

| 531 WORD NAME | 533 VOICE INFORMATION | 535 READ-ALOUD DURATION (SEC) |
|---|---|---|
| FUJITSU LIMITED | | 3.0 |
| ABCD CO., LTD | | 3.0 |
| REPRESENTATIVE DIRECTOR | | 3.0 |
| IS | | 0.3 |
| RECENTLY | | 2.0 |
| STRATEGIC | | 2.0 |
| THE | | 0.3 |
| PARTNERSHIP | | 2.0 |

FIG. 3

| 551 SYLLABLE NAME | 553 SYLLABLE INFORMATION | 555 READ-ALOUD DURATION (SEC) |
|---|---|---|
| ku | | 0.11 |
| ru | | 0.12 |
| ro | | 0.13 |
| ok | | 0.14 |

| 571 WORD NAME | 573 SYMBOL INFORMATION |
|---|---|
| FUJITSU LIMITED | FUJITSU LOGO |
| ABCD CO., LTD. | ABCD LOGO |

SENTENCE READING ALOUD APPARATUS, CONTROL METHOD FOR CONTROLLING THE SAME, AND CONTROL PROGRAM FOR CONTROLLING THE SAME

CROSS-REFERENCE TO RELATED APPLICATION

This application is a continuation application of, and claims the benefit of priority of, the prior International Application No. PCT/JP2006/323427, filed on Nov. 24, 2006, the entire contents of which are incorporated herein by reference.

FIELD

The embodiments discussed herein are related to a technology for complementing unnatural read-aloud voice generated by a sentence reading aloud apparatus for reading aloud a sentence written in a text file or the like.

BACKGROUND

Software for reading aloud a text file while displaying it is already commercially available. Such reading aloud software uses a word database (DB) that stores a word and voice information and a syllable DB that stores syllable information. Voice information used herein refers to information obtained by encoding sound of a word pronounced by a human being. Also, a syllable in syllable information refers to the smallest unit of sound that is abstracted so as to form a concrete voice. The syllable information refers to information obtained by encoding sound of a syllable extracted from sound of a word pronounced by a human being. If a word in a sentence to be read aloud is found in such a word database, the afore-mentioned voice information can be used, causing its voice to be naturally audible to a human being. In contrast, if a word in a sentence to be read aloud is not found in the word database, synthetic voice information obtained by combining the afore-mentioned syllable information is used. The synthetic voice information is information obtained by combining syllable information and making adjustments to an accent and an intonation to make it more natural. However, a synthetic voice based on this synthetic voice information sounds unnatural to a human being, as is expected. Related technologies are disclosed by Japanese Laid-open Patent Publication No. 08-87698 and Japanese Laid-open Patent Publication No. 2005-265477.

SUMMARY

According to an aspect of the invention, an apparatus for voice synthesis includes: a word database for storing data of a plurality of words and a plurality of voices corresponding to the words, respectively; a syllable database for storing data of a plurality of syllables and a plurality of voices corresponding to the syllables, respectively; a processor for executing a process including: extracting a word from a document, determining whether data of a word corresponding to the extracted word is included in the word database, extracting data of a voice associated with the word corresponding to the extracted word from the word database when the extracted word is included in the word database, and generating a voice signal based on the extracted voice data associated with the word corresponding to the extracted word, extracting data of a voice associated with one or more syllables corresponding to the extracted word from the syllable database when the extracted word is not found in the word database, and synthesizing a voice signal based on the extracted voice data associated with the one or more syllables corresponding to the extracted word; a speaker for producing a voice based on either of the generated voice signal and the synthesized voice signal; and a display for selectively displaying the extracted word when the voice based on the synthesized voice signal is produced by the speaker.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 2 is a configuration diagram of a word DB.

FIG. 3 is a configuration diagram of a syllable DB.

DESCRIPTION OF EMBODIMENTS

Before embodiments are described, as an example, a situation where the present invention may be effective will be described below. When a person hears a word spoken in an unnatural synthetic voice as described above, he or she cannot readily understand what the word means. In particular, it is difficult to readily understand the meaning of a word in the following situations. "Word" used herein refers to the smallest unit of language that represents a cognitive unit of meaning for grammatical purposes.

(1) he or she has no time to identify the word since he or she is operating a machine or traveling, (2) the word is unknown to him or her, so he or she cannot understand even if the word is pronounced in a natural voice, or (3) hardware displaying the word is too small for him or her to identify the spelling of the word.

The present invention may be effective to complement a word spoken in an unnatural synthetic voice.

Embodiments 1 and 2 according to the present invention will now be described below with reference to the accompanying drawings.

Embodiment 1

[1. Block Diagram Illustrating Hardware Configuration]

Figure 1:
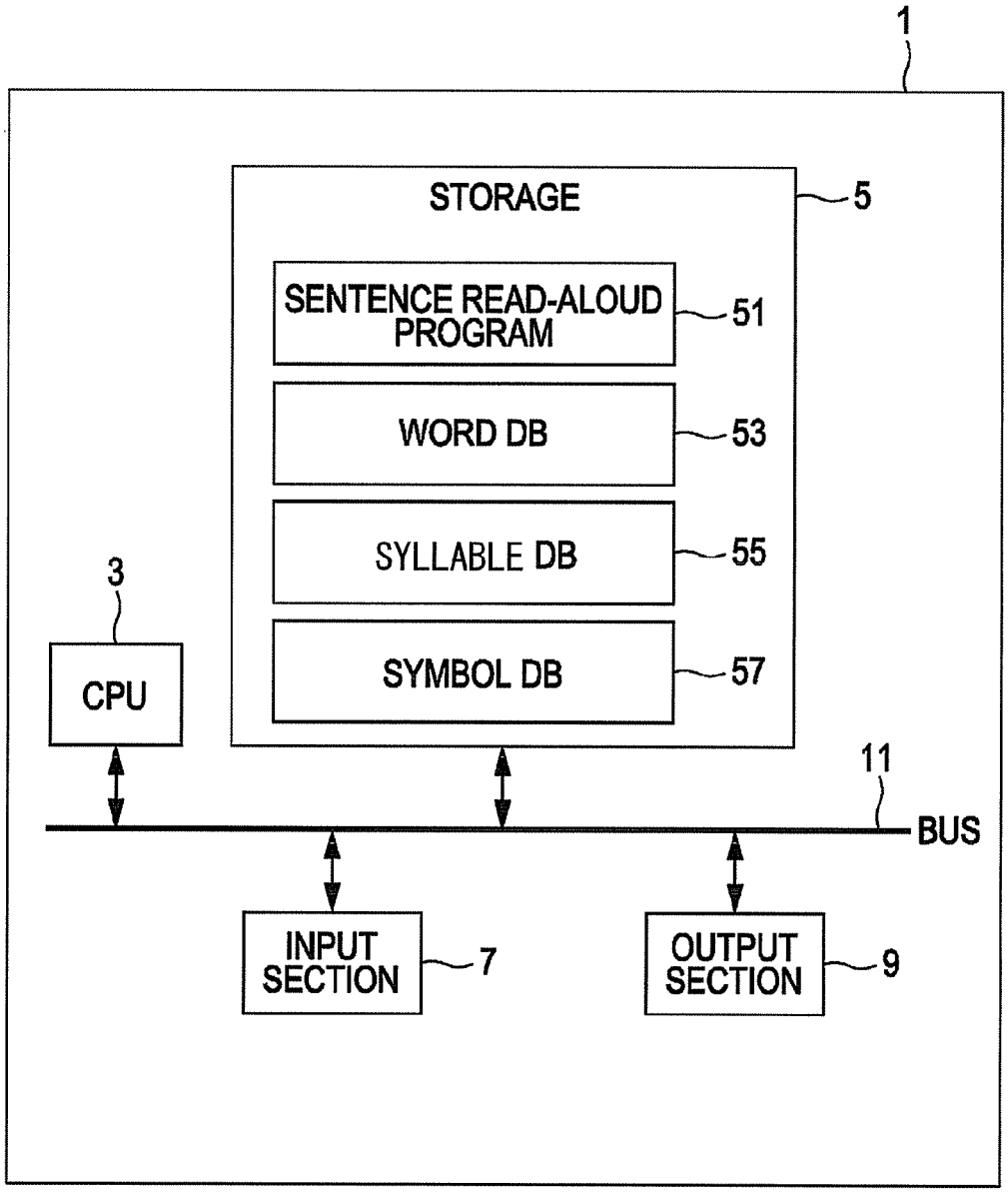
FIG. 1 is a hardware configuration diagram of a sentence reading aloud apparatus.

FIG. 1 is a hardware configuration diagram of a sentence reading aloud apparatus. The sentence reading aloud apparatus 1 consists of a Central Processing Unit (CPU) 3, a storage 5, an input section 7, an output section 9, and a bus 11. The CPU 3 performs control of various sections as well as various kinds of calculations. The storage 5 stores a sentence read-aloud program 51, a word DB 53, a syllable DB 55, and a symbol DB 57 therein, and operates as a RAM (Random Access Memory) for executing a program or storing data, a ROM (Read Only Memory) for storing a program and data, and an external storage device for storing large amounts of data and programs. When receiving a document to be read aloud and a read-aloud request from the input section 7, the sentence read-aloud program 51 performs read-aloud processing with the word DB53, the syllable DB 55, and symbol DB 57. The read-aloud processing includes a function for complementing the synthetic voice of a word whose voice information is not stored. The word DB 53 stores word-based voice information used for reading aloud. The syllable DB 55 stores syllable information used for reading aloud. The symbol DB 57 stores symbol information for complementing the afore-mentioned synthetic voice. The input section 7 provides a document to be read aloud and a request for sentence read-aloud processing from the outside into the sentence reading aloud apparatus 1. Specifically, the input section 7 includes a communication interface for entering an e-mail as a document to be read aloud, or a unit that can be operated with button action for a request for reading aloud of a document or termination of display of notation information to be described below. The output section 9 outputs read-aloud voice or the notation information regarding the read-out voice to the outside. Specifically, it includes a unit operating as a speaker or a monitor. The bus 11 may be a subsystem through which data is transferred among the CPU 3, the storage 5, the input section 7, and the output section 9. "Sentence" used herein refers to a grammatical unit of one or more words expressing a thought or an emotion.

The sentence input apparatus 1 is briefly described below.

(1) A document to be read aloud and a request for reading aloud it are received from the input section 7.

(2) The CPU 3 expands the sentence read-aloud program 51 in the RAM and executes the sentence read-aloud program 51. The sentence read-aloud program 51 uses the document to be read aloud given in item (1), the word DB 53, the syllable DB 55, and the symbol DB 57 to generate read-aloud voice information for the document to be read aloud as well as the notation information corresponding to the read-aloud voice information.

(3) The output section 9 outputs the read-aloud voice information generated in item (2) and the notation information corresponding to the read-aloud voice information to the outside.

[1.1 Configuration Diagram of Word DB]

FIG. 2 illustrates the word DB 53 that stores the voice information for a word. The word DB 53 is a database from which the sentence reading aloud apparatus 1 extracts voice information for a word used in a document to be read aloud. The information element of the word DB 53 includes a word name 531, voice information 533, and read-aloud duration 535. The word name 531 is the information from which the sentence reading aloud apparatus 1 searches for voice information for a word used in a sentence to be read aloud. The voice information 533 is the information which the voice reading aloud apparatus 1 uses to output a voice for a word from the output section 9 to the outside. This voice information is the information obtained by encoding a voice of a word pronounced by a human being, and, in some cases, information obtained by compressing it. The read-aloud duration 535 is a period of time for reading aloud the voice information 533. The read-aloud duration 535 is the information with which the sentence reading aloud apparatus 1 calculates an occasion for displaying the notation information for a word that is not found in the word DB 533.

[1.2 Configuration Diagram of Syllable DB]

FIG. 3 illustrates the syllable DB 55 that stores syllable information. The syllable DB 55 is a database with which the sentence reading aloud apparatus 1 synthesizes a voice that is not found in the word DB 53. The information element of the syllable DB 55 includes a syllable name 551, syllable information 553, and a read-aloud duration 555. The syllable name 551 is information from which the sentence reading aloud apparatus 1 extracts syllable information for synthesis. The syllable information 553 is information with which the sentence reading aloud apparatus 1 synthesizes voice information for a word that is not found in the word DB 53. The syllable information 553 is the information obtained by encoding the voice of a syllable extracted from the voice of a word pronounced by a human being, and, in some cases, the information obtained by compressing it. The read-aloud duration 555 is a period of time for reading aloud the syllable information 553. The read-aloud duration 555 is the information with which the sentence reading aloud apparatus 1 calculates an occasion for displaying the notation information for a word that is not found in the word DB 533.

[1.3 Configuration Diagram of Symbol DB]

Figures 4, 5:
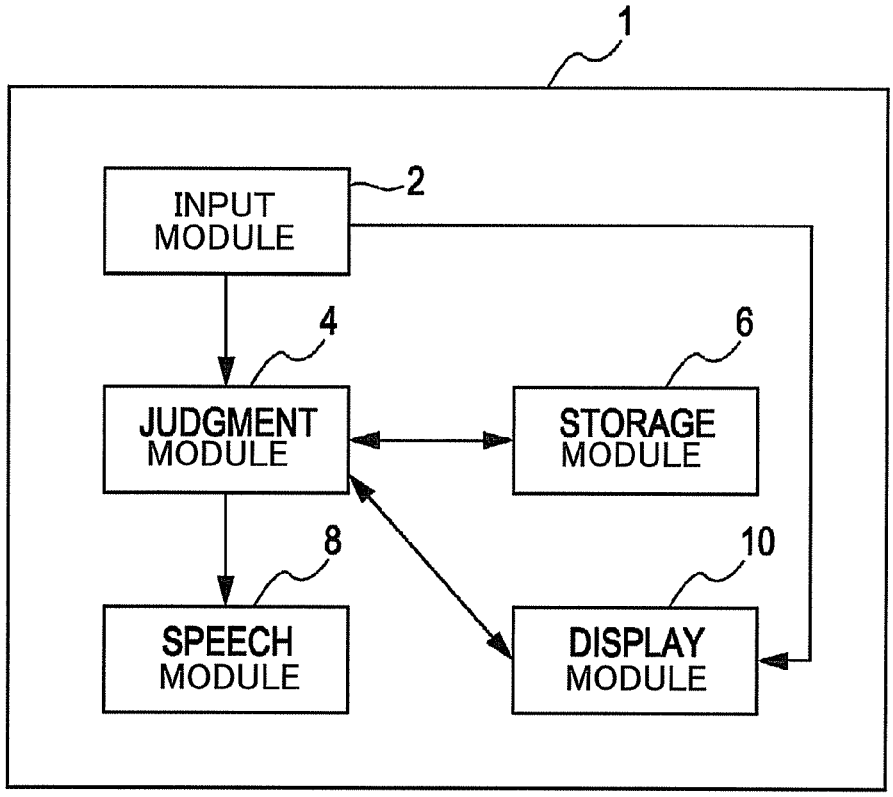
FIG. 4 is a configuration diagram of a symbol DB.
FIG. 5 is a functional block diagram of sentence read-aloud processing.

FIG. 4 illustrates the symbol DB 57 that stores the symbol for a word that is not found in the word DB 53. The symbol DB 57 is used by the sentence reading aloud apparatus 1 to display a symbol related to the meaning of a word that is not found in the word DB 53, but used in a document to be read aloud. Symbol used herein means a sign other than a letter. The information element of the symbol DB 57 includes a word name 571 and symbol information 573. Letter used herein means one or more signs representing a word. The word name 571 is the information from which the sentence reading aloud apparatus 1 searches for symbol information for a word that is used in a document to be read aloud. The symbol information 573 is information used by the voice reading aloud apparatus 1 to output a symbol related to the meaning of a word from the output section 9 to the outside. As an example, a company logo is stored.

[2. Functional Block Diagram]

FIG. 5 is a functional block diagram illustrating an example of a sentence read-aloud function. The read-aloud function provided by the sentence reading aloud apparatus 1 is performed by executing the sentence read-aloud program 51. The sentence read-aloud function consists of an input module 2, a judgment module 4, a storage module 6, a speech module 8, and a display module 10. Each modules of the sentence read-aloud function is described below.

[Input Module]

The input module 2 provides the sentence reading aloud apparatus 1 with a document to be read aloud and a read-aloud request for it. Also, it provides the display module 10 with a request to terminate display of the notation information to be described below.

[Judgment Module]

The judgment module 4 performs the following.

(1) Uses a document to be read aloud provided by the input module 2 and word-based voice information or syllable information stored in the storage module 6 to generate entire voice information corresponding to the sentence to be read aloud. Also, when the entire voice information contains synthetic voice information, the judgment module 4 sets an occasion for reading aloud the synthetic voice information, which it monitors during a speech. Synthetic voice information used herein refers to information obtained by generating voice information for an unstored word whose voice information is not present in the storage module using the afore-mentioned syllable information. Then, the entire voice information is provided to the speech module 8.

(2) Monitors the occasion for reading aloud the synthetic voice information for the unstored word. When the occasion is detected, the notation information corresponding to the letters and symbols of the unstored word is provided to the display module 10.

[Storage Module]

The storage module 6 stores word-based voice information and word-based symbol information. The word-based voice information corresponds to the word DB 53. The syllable information corresponds to the syllable DB 55. The symbol information corresponds to the symbol DB 57.

[Speech Module]

The speech module 8 receives the entire voice information from the judgment module 4 and delivers it to the outside in the form of a voice.

[Display Module]

The display module 10 receives the notation information from the judgment module 4 and delivers it to the outside in the form of a letter or a symbol. In response to a request for termination of display of the notation information from the input module 2, processing for delivering letters and symbols to the outside is terminated.

[3. Sentence Read-Aloud Processing]

Figure 6:
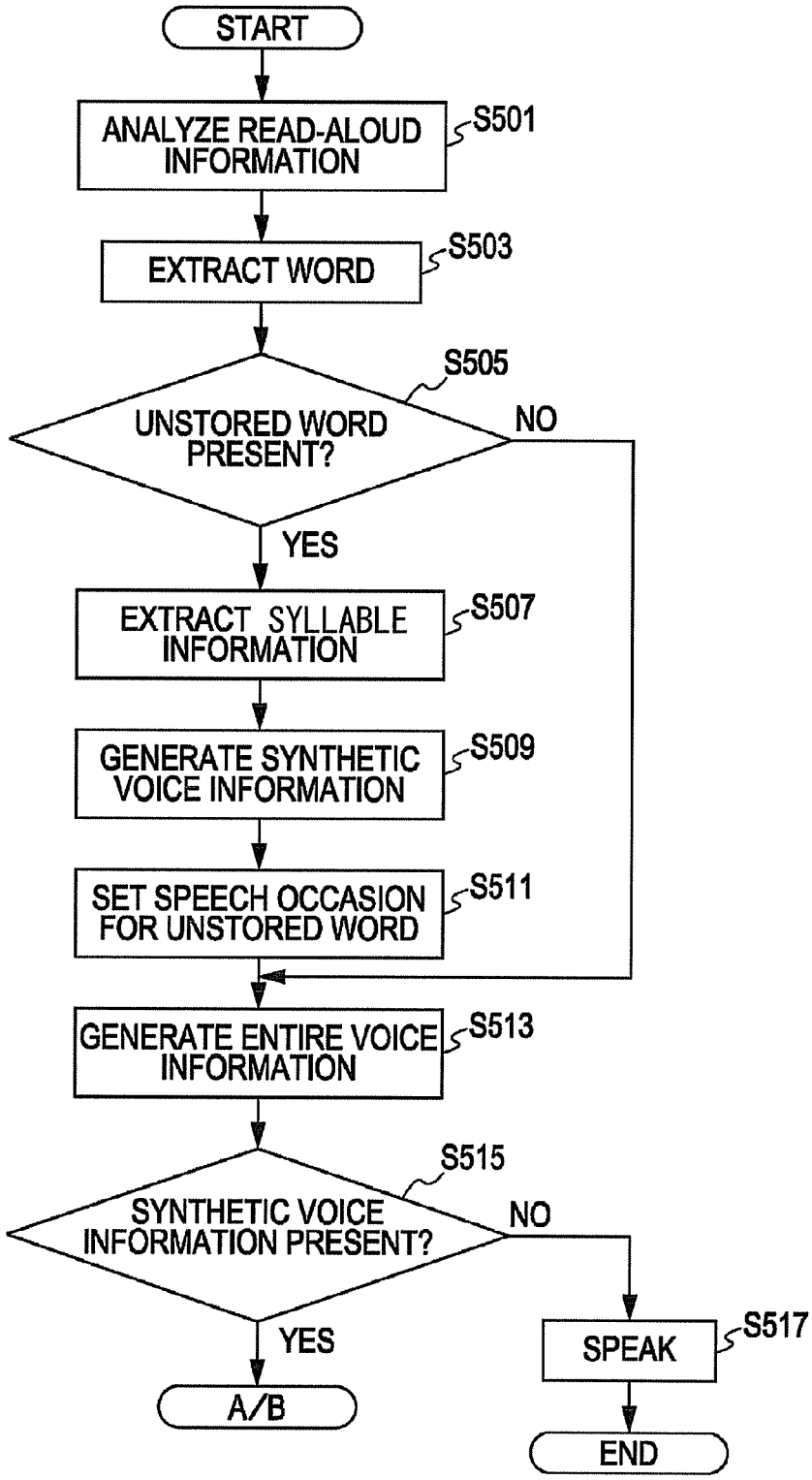
FIG. 6 is a flowchart (No. 1) illustrating sentence read-aloud processing according to Embodiment 1.
Figure 7:
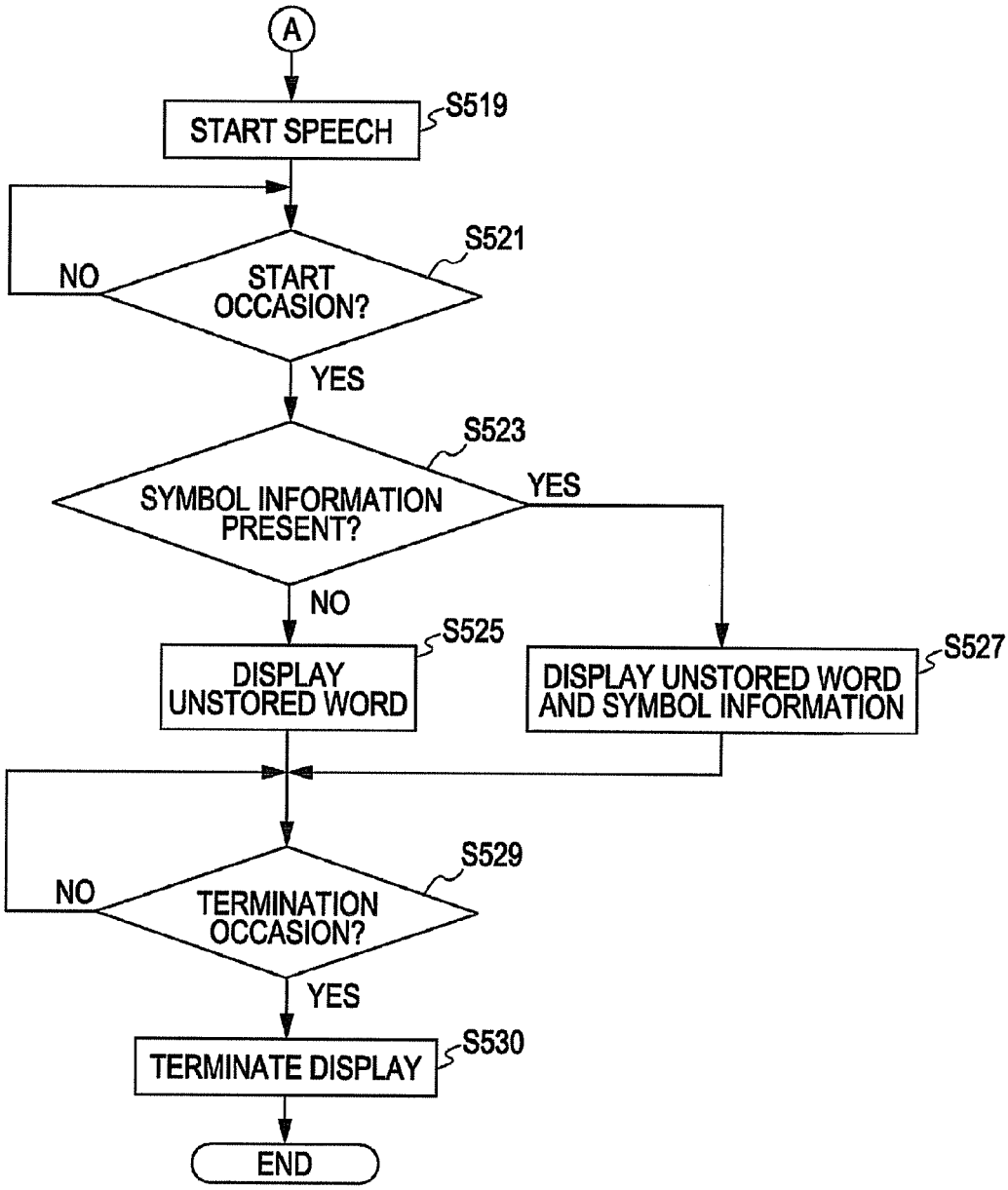
FIG. 7 is a flowchart (No. 2) illustrating sentence read-aloud processing according to Embodiment 1.

Sentence read-aloud processing according to Embodiment 1 is described below with reference to FIGS. 6 and 7.

In step S501, the judgment module 4 makes an analysis of a document to be read aloud or read-aloud information supplied by the input module 2. Analysis used herein refers to a judgment as to whether or not voice information for a word used in the sentence to be read aloud is found in the voice DB 53.

In step S503, the judgment module 4 extracts an unstored word identified in step S501, whose voice information 533 is not found in the voice DB 53, from all of the words used in the sentence to be read aloud.

In step S505, the judgment module 4 makes a judgment as to whether or not an unstored word whose voice information is not found in the voice DB 53 is present. If such a judgment finds that an unstored word whose voice information is not found is present, the processing of S507 is performed. If such a judgment finds that an unstored word whose voice information is not found is not present, the processing of step S513 is performed.

In step S507, the judgment module 4 extracts from the syllable DB 55 the syllable information corresponding to the unstored word extracted in step S503. Specifically, such extraction is performed as follows. In accordance with rule information retained by the sentence reading aloud apparatus 1, an unregistered word is converted into Roman letters representing how it is read. Then, the syllable information 553 corresponding to a syllable name contained in the Roman letters is extracted from the syllable DB 55.

In step S509, the judgment module 4 combines the syllable information 553 extracted in step S507 and generates synthetic voice information for the unregistered word. Then such synthetic voice information is edited in such a manner that the synthetic voice falls within amplitude threshold retained by the sentence reading aloud apparatus 1. Such editing is intended to cause the rhythm of the synthetic voice to sound natural.

In step S511, the judgment module 4 sets an occasion for reading aloud the synthetic voice for the unregistered word in the document to be read aloud. Specifically, such setting is performed as follows. Read-aloud durations 535 of the words, beginning with the first word in the sentence to be read aloud and ending with the word preceding the unstored word, are summed up to determine the duration in order to speak the voice information. The duration thus determined is stored in the storage 5 as a display start occasion for the unstored word. Then, read-aloud durations 555 of the syllable information used to generate the synthetic voice for the unstored word are summed up to determine the duration in order to speak the synthetic voice. The duration thus determined plus the above display start occasion is stored in the storage 5 as a display termination occasion for the unstored word. If more than one unstored word is present in the sentence to be read aloud, the above processing is repeated.

In step S513, the judgment module 4 generates an entire voice corresponding to the entire sentence to be read aloud. Such entire voice information can be generated either by combining only the voice information 533 in the word DB 53 or combining the voice information 533 in the word DB 53 with the synthetic voice information generated in step S509. Then, the loudness and sound pitch of the entire voice information is adjusted according to the rule information retained by the sentence reading aloud apparatus 1. This adjustment is intended for the entire voice information to sound natural.

In step S515, the judgment module 4 makes a judgment as to whether the entire voice information generated in step S513 contains the synthetic voice information generated in step S509. If such a judgment finds that the entire voice information generated in step S513 contains the synthetic voice information generated in step S509, the processing of step S519 is performed. If such a judgment finds that the entire voice information generated in step S513 does not contain the synthetic voice information generated in step S509, the speech module 8 speaks the entire voice information in the processing of step S517.

In step S519, the speech module 8 starts speaking the entire voice synthesized in step S513. This entire voice information is generated by combining the voice information 533 in the word DB 53 with the synthetic voice information synthesized in step S509.

In step S521, the judgment module 4 monitors whether the length of time that has elapsed since the entire voice information is spoken in step S519 reaches the display start occasion determined in step S511. Such monitoring is performed until the length of time that has elapsed since the speech of the entire voice information began in step S519 reaches the display start occasion determined in step S511. If this monitoring finds that the length of time that has elapsed since the speech of the entire voice information began in step S519 reaches the display start occasion determined in step S511, the processing of S523 is performed.

In step S523, the judgment module 4 makes a judgment as to whether or not the symbol information of the unstored word corresponding the display start occasion is present in the symbol DB 57. Is such a judgment finds that the symbol information for the unstored word is not present in the symbol DB 57, in step S525 the display module 10 displays in the output section 9 the literal information for the unstored word extracted in step S503. If such a judgment finds that the symbol information for the unstored word is present in the symbol DB 57, in step S527 the display module 10 displays in the output section 9 the literal information for the unstored word extracted in step S503 as well as the symbol information in the symbol DB 57.

Figure 9:
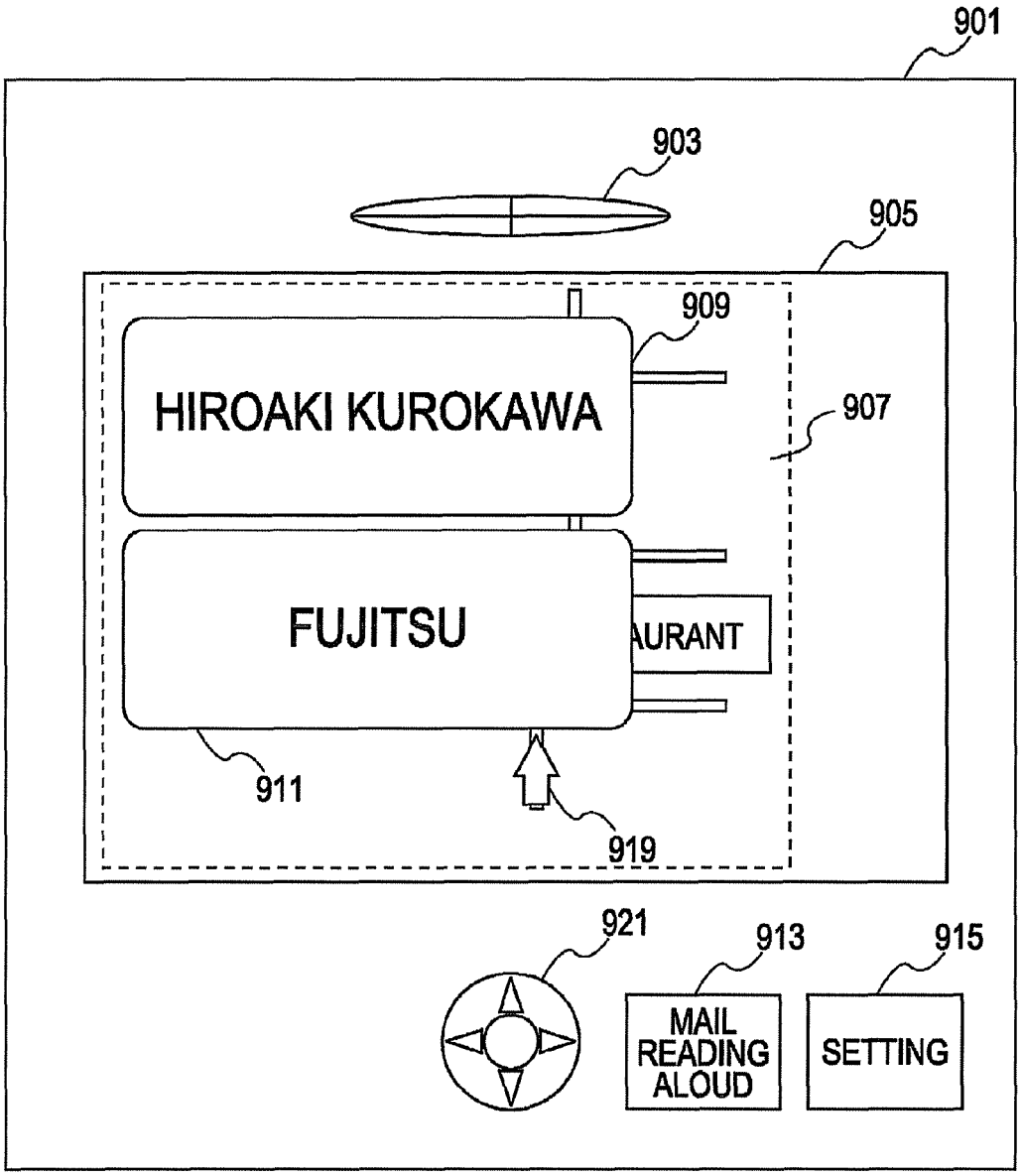
FIG. 9 is an example of display for complementing a synthetic voice.

Examples of S525 and S527 are described below with reference to FIG. 9. FIG. 9 illustrates an example of the sentence reading aloud apparatus 1 that is commercialized as a car navigation system having a navigation feature. Reference numeral 901 denotes a car navigation system. 903 denotes a speaker for outputting a read-aloud voice. 905 denotes a screen for displaying a map or the like used for navigation. 907 denotes a map used for navigation. 909 denotes letters of the unstored word displayed in S525. In this case, 909 denotes a personal name as a unstored word. 911 denotes the symbol information displayed in S527. In this case, 911 denotes the logo of the company associated with the personal name in reference numeral 909 as the symbol information corresponding to reference numeral 909. 913 denotes a mail read-aloud button. This mail read-aloud button is used to cause the car navigation system 1 to read aloud an e-mail that it receives. 915 denotes a setting button. The setting button is used to make various settings for the car navigation system. 919 denotes a mark which indicates the location on a map 907 of a vehicle provided with the car navigation system. S921 denotes a controller. The controller is used to specify a destination on the map 907. The literal information displayed in step S525 is equivalent to reference numeral 909. The literal information and the symbol information displayed in step S527 are equivalent to 909 and 911, respectively.

In step S529, the judgment module 4 monitors whether or not the length of time that has elapsed since the display start occasion detected in step S521 reaches the display termination occasion determined in step S511. Such monitoring is performed until the length of time that has elapsed since the display start occasion detected in step S521 reaches the display termination occasion determined in step S511. If such monitoring finds that the length of time that has elapsed since the display start occasion detected in step S521 reaches the display termination occasion determined in step S511, display of the information appearing in the display module 10 is terminated in step S530.

Embodiment 2

In Embodiment 2, sentence read-aloud processing where the occasion for terminating display of an unstored word and a symbol corresponding to the unstored word is different from Embodiment 1 is described below.

Description of processing in steps before the unstored word display and the unstored word and symbol information display is omitted since it is the same as that in Embodiment 1.

Figure 8:
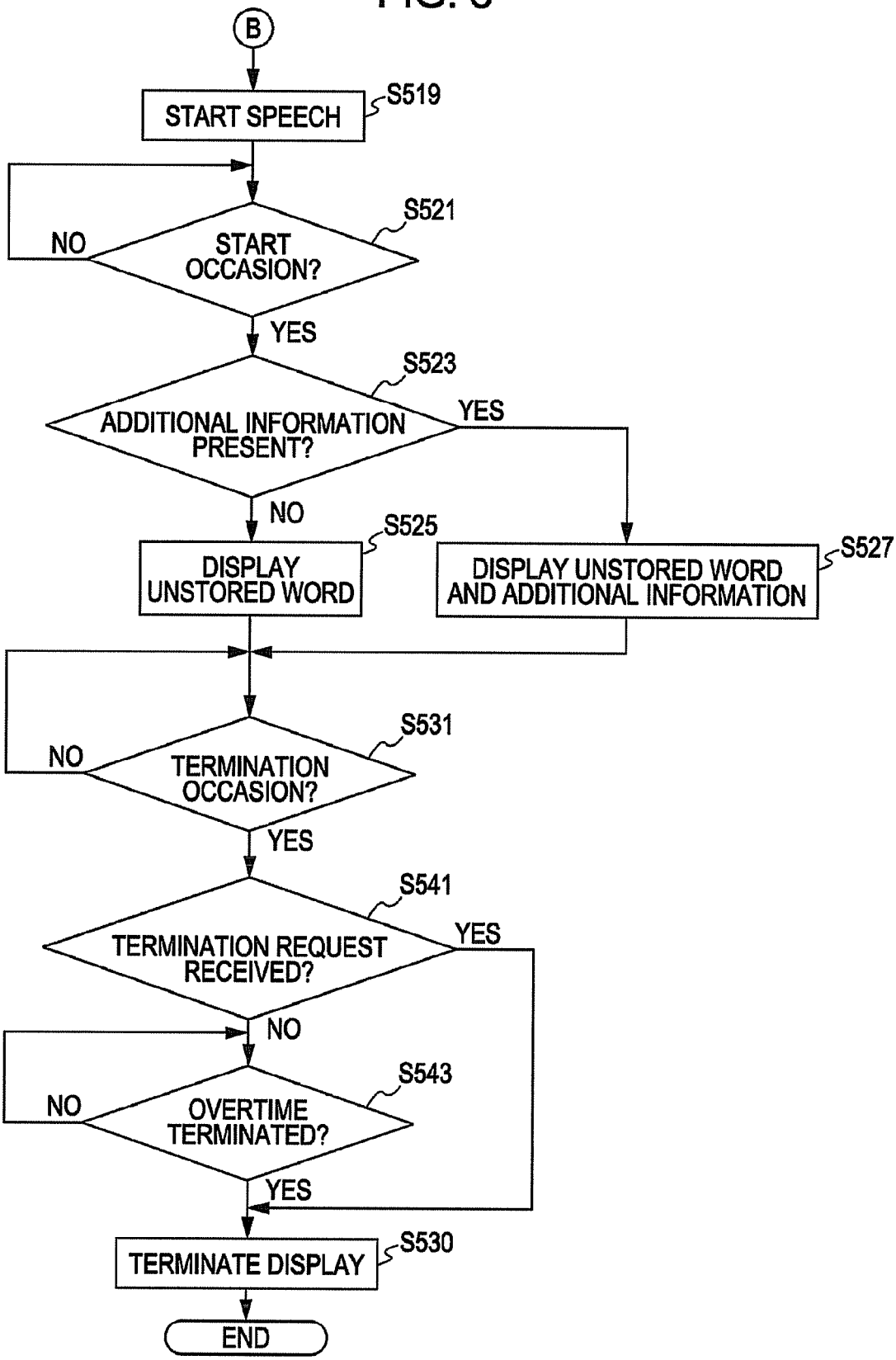
FIG. 8 is a flowchart illustrating sentence read-aloud processing according to Embodiment 2.

Sentence read-aloud processing according to Embodiment 2 is described below with reference to FIG. 8.

In step S531, the judgment module 4 monitors whether or not the length of time that has elapsed since the display start occasion detected in step S521 reaches the display termination occasion determined in step S511. Such monitoring is performed until the length of time that has elapsed since the display start occasion detected in step S521 reaches the display termination occasion determined in step S511. If such monitoring finds that the length of time that has elapsed since the display start occasion detected in step S521 reaches the display termination occasion determined in step S511, the processing of step S541 is performed.

In step S541, the judgment module 4 makes a judgment as to whether or not a termination request from the outside to terminate display of an unstored word or a symbol corresponding to the unstored word is received from the input module 2. If such a judgment finds that such a termination request is received, display of the information appearing in the display module 10 is terminated in step S530. If such a judgment finds that such a termination request is not received, the processing of step S543 is performed.

In step S543, the judgment module 4 makes a judgment as to whether the length of time that has elapsed since the display termination occasion detected in step S531 reaches an overtime that the sentence reading aloud apparatus 1 retains in the storage 5. Such a judgment is continued until the length of time that has elapsed since the display termination occasion detected in step S531 reaches the overtime. If such a judgment finds that the length of time that has elapsed since the display termination occasion detected in step S531 reaches the overtime, display of the information appearing in the display module 10 is terminated in step S530.

The present invention is typically described with reference to, but not limited to, the foregoing preferred embodiments. Various modifications are conceivable within the scope of the present invention.

Industrial Applicability

The present invention is a technology that complements an unnatural read-aloud voice in a sentence reading aloud apparatus for reading aloud a sentence written in a text file or the like, and can be applied to a navigation system or a mobile terminal.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An apparatus for voice synthesis comprising:

a word database to store data of a plurality of registered words and a plurality of registered word voices corresponding to the registered words, respectively;

a syllable database to store data of a plurality of syllables and a plurality of syllable voices corresponding to the syllables, respectively;

a processor to execute a process of:

extracting a plurality of words from a document, determining whether each word of the plurality of words extracted from the document is included in the word database, extracting a registered word voice from the word database that is associated with one of the words extracted from the document, generating a voice signal based on the registered word voice, extracting one or more syllable voices from the syllable database that is associated with one or more syllables included in an other word extracted from the document, when the other word extracted from the document is not found in the word database, synthesizing an other voice signal based on the one or more extracted syllable voices, outputting one or more of voice signals, and other voice signals to a speaker that outputs voice, based on the voice signals and the other voice signals, selectively displaying for a determined duration an other word not found in the word database, when an other voice signal is output by the speaker, and when the other voice signal based upon the one or more extracted syllables is synthesized, setting a display start time for starting the displaying of the other word not found in the word database when the other voice signal is output.

2. The apparatus according to claim 1, further comprising a symbol database to store a plurality of symbols corresponding to words, and wherein the displaying of the other word further comprises displaying a symbol corresponding to the other word when the other voice signal is output by the speaker.

3. The apparatus according to claim 1, wherein the displaying of the other word is terminated in response to a request from outside.

4. A method of voice synthesis by an apparatus that accesses a word database for storing data of a plurality of registered words and a plurality of registered word voices corresponding to the registered words, respectively, and accesses a syllable database for storing data of a plurality of syllables and a plurality of syllable voices corresponding to the syllables, respectively, the apparatus including a speaker and a display, the method comprising:

configuring the apparatus to execute:

extracting a plurality of words from a document;

determining whether each word of the plurality of words extracted from the document is included in the word database;

extracting a registered word voice from the word database that is associated with one of the words extracted from the document, generating a voice signal based on the registered word void, extracting one or more syllable voices from the syllable database that is associated with one or more syllables included in an other word extracted from the document, when the other word extracted from the document is not found in the word database, synthesizing an other voice signal based on the one or more extracted syllable voices, outputting one or more of voice signals, and other voice signals to the speaker;

selectively displaying for a determined duration an other word not found in the word database on the display, when an other voice signal is output by the speaker, and when the other voice signal based upon the one or more extracted syllables is synthesized, setting a display start time for starting the displaying of the other word not found in the word database when the other voice signal is output.

5. The control method according to claim 4, further comprising a symbol database to store a plurality of symbols corresponding to words, wherein the displaying of the other word further comprises display a symbol corresponding to the other word when the other voice signal is output by the speaker.

6. The control method according to claim 4, wherein the displaying of the other word is terminated in response to a request from outside.

* * * * *

UNITED STATES PATENT AND TRADEMARK OFFICE

CERTIFICATE OF CORRECTION

PATENT NO. : 8,315,873 B2
APPLICATION NO. : 12/463532
DATED : November 20, 2012
INVENTOR(S) : Shinichiro Mori It is certified that error appears in the above-identified patent and that said Letters Patent is hereby corrected as shown below:

Column 9, Line 21, In Claim 4, delete "void," and insert -- voice, --, therefor.

Signed and Sealed this
Twelfth Day of March, 2013

Teresa Stanek Rea
*Acting Director of the United States Patent and Trademark Office*